US005826785A

United States Patent [19]

Belvederi et al.

[11] Patent Number: 5,826,785

[45] Date of Patent: Oct. 27, 1998

[54] RIGID HINGED-LID PACKET FOR LONG ELEMENTS

[75] Inventors: Bruno Belvederi, S. Martino di Monte S. Pietro; Fiorenzo Draghetti, Medicina, both of Italy

[73] Assignee: G.D. S.p.A.

[21] Appl. No.: 92,262

[22] Filed: Jun. 5, 1998

[30] Foreign Application Priority Data

Jun. 6, 1997 [IT] Italy ..... BO97A0341

[51] Int. Cl.[6] ..... B65D 5/42

[52] U.S. Cl. ..... 229/162; 206/273; 229/160.1

[58] Field of Search ..... 229/146, 160.1, 229/162; 206/268, 273

[56] References Cited

U.S. PATENT DOCUMENTS 5,503,268 4/1996 Pham .

FOREIGN PATENT DOCUMENTS

| | | |
|---|---|---|
| 739 729 | 3/1978 | Belgium . |
| 1 996 454 | 11/1968 | Germany . |
| 87 11 574 | 8/1987 | Germany . |
| 491 791 | 7/1970 | Switzerland . |

*Primary Examiner*—Gary E. Elkins

*Attorney, Agent, or Firm*—IP Group of Pillsbury Madison & Sutro LLP

[57] ABSTRACT

The rigid hinged-lid packet for long elements comprises a cup-shaped container, a lid, also cup-shaped, hinged at the top rear end of the container to close an open end of the container, and an inner frame, partly inside the container and fixed to a front surface and two side surfaces of the container; the front surface of the container having a window, designed to show a given zone of the inner frame behind it, the zone presenting a given image, and the window being covered by a tear-off closing element. [FIG. 2].

7 Claims, 2 Drawing Sheets

RIGID HINGED-LID PACKET FOR LONG ELEMENTS

BACKGROUND OF THE INVENTION

The present invention relates to a rigid hinged-lid packet for long elements.

In particular, the present invention relates to a rigid hinged-lid packet for items for smokers, such as cigarettes, cigars, or similar items, to which the following description refers, although without limiting the general possibilities for application of the present invention.

Such rigid packets are normally made from a ready-weakened flat blank, and are of the type which comprises a cup-shaped container, a lid, this also being cup-shaped and hinged at the top rear end of the container, and an inner frame positioned partly inside the container, fixed to the front surface and the two side surfaces of the container.

In the tobacco industry sector, packets of the aforementioned type are made so that they include inserts such as cards, coupons, or similar items, bearing text, figures, or, more often, images which constitute various types of messages directed at the consumer. Such messages may, for example, be advertisements, or may refer to prize competitions, collections, etc.

The inserts are normally placed in packets of the aforementioned types during formation of the packets, and are visible only after the packet has been opened. The insertion of such inserts in the relative packets is a serious problem, since it requires special cigarette packaging machines, with obvious economic disadvantages.

In the tobacco industry sector, packets of the aforementioned types are also made with graphics in particular colors on the front surface, sometimes in relief, these graphics being very expensive when combined with the creation of other, different, graphics on other parts of the packet and/or, especially in the case of relief graphics, sometimes slowing down the sliding of the relative blanks over one another when the blanks are picked up from stacks.

The aim of the present invention is to provide a packet of the aforementioned type, providing a simple, economical solution to the above-mentioned disadvantages.

SUMMARY OF THE INVENTION

The present achieves this aim by providing a rigid hinged-lid packet for long elements, the packet comprising a cup-shaped container which has a front surface, a rear surface and two side surfaces which define an open end of the container; an inner frame with a front portion and two side portions which are attached to the aforementioned front and side surfaces, the inner frame comprising a first portion positioned inside the container and a second portion protruding from the open end of the container; and a cup-shaped lid, hinged at the rear edge of the open end of the container in such a way that it rotates between a position in which the container is open and a position in which it is closed; the packet being characterized by the fact that the front surface has a window designed to show a given zone of the first portion of the inner frame.

In a preferred embodiment of the present invention, said zone bears graphics.

Moreover, the aforementioned packet preferably comprises means which can be torn off and which are designed to hide said zone.

BRIEF DESCRIPTION OF THE DRAWINGS

The invention will now be described with reference to the accompanying drawings which illustrate a preferred embodiment that does not limit its application, and in which.

DESCRIPTION OF THE PREFERRED EMBODIMENTS

Figure 2:
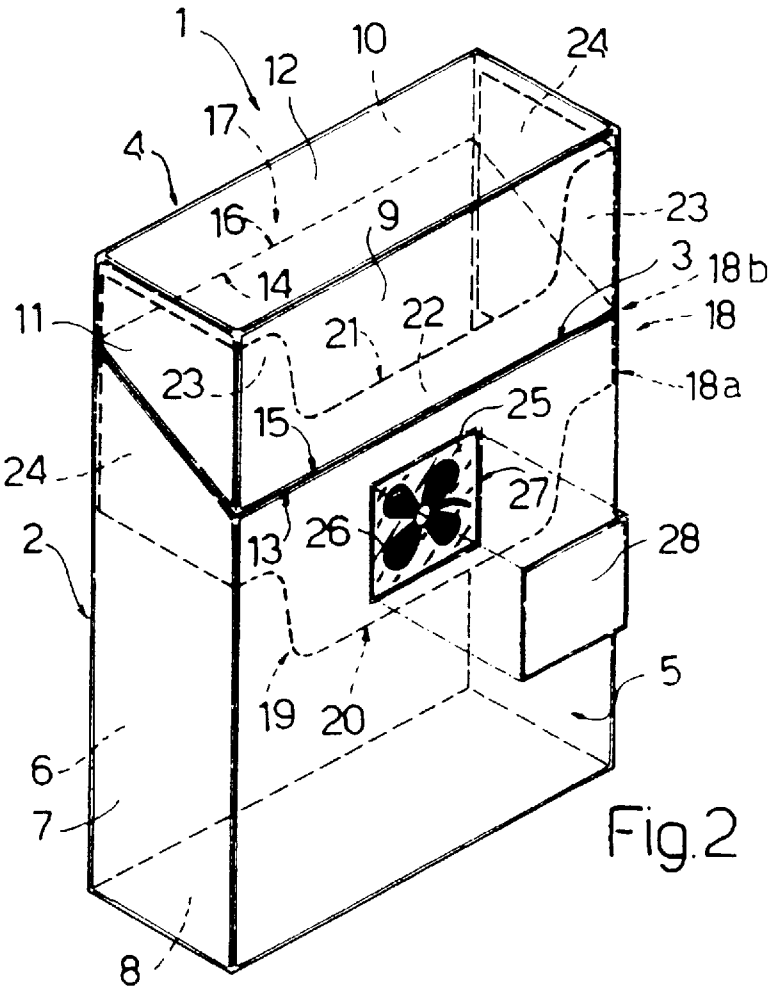
FIG. 2 is an exploded perspective view of the packet in FIG. 1.
Figure 1:
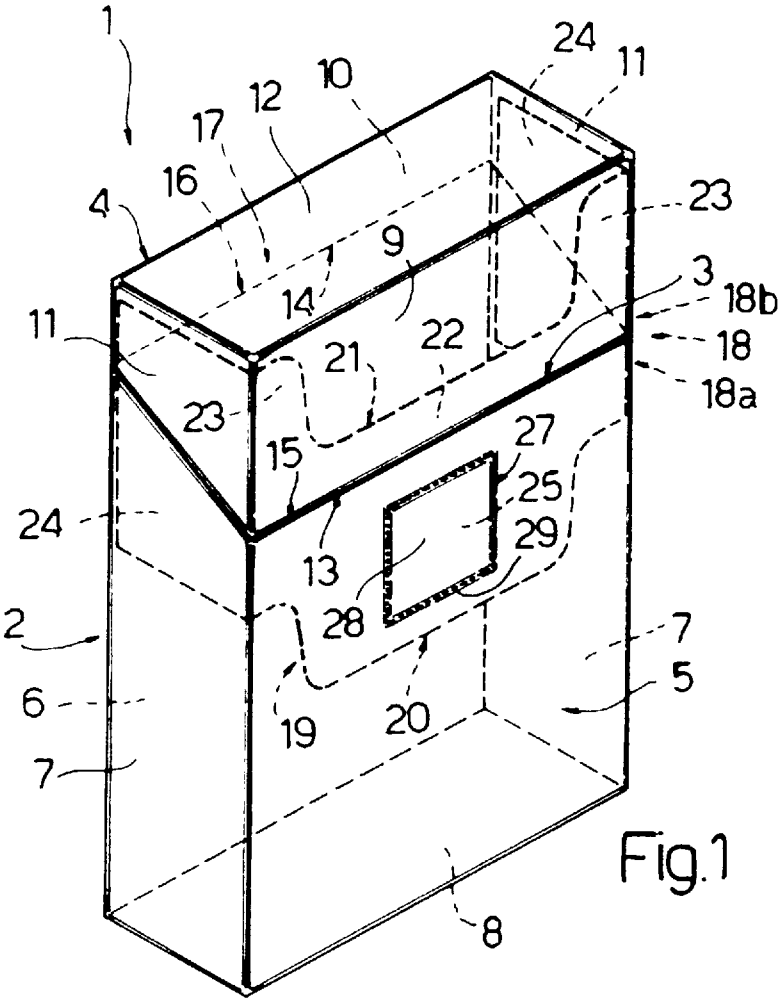
FIG. 1 is a perspective view of a preferred embodiment of the packet disclosed.

With reference to the accompanying drawings, the numeral 1 indicates a rigid packet designed to contain a group (not illustrated) of cigarettes, and comprising a cup-shaped container 2 at the bottom with an open end 3 and a lid 4 at the top, the lid also being cup-shaped and being hinged to the container 2 so that it rotates between a position in which the end 3 is open (not illustrated) and a position in which it is closed (FIGS. 1 and 2).

The container 2 has a front surface 5 and a rear surface 6 which are opposite one another and parallel and two side surfaces 7 which are parallel with one another and perpendicular to the front and rear surfaces 5 and 6, and a base 8, perpendicular to surfaces 5, 6 and 7.

The lid 4 has a front surface 9 and a rear surface 10, opposite to and parallel with one another, two parallel side surfaces 11 which are perpendicular to surfaces 9 and 10, and a base 12, perpendicular to surfaces 9, 10 and 11. Surfaces 9 and 10 have free edges, respectively 13 and 14, positioned opposite respective free edges 15 and 16 of surfaces 5 and 6, and edge 14 is integral with edge 16, thus defining, together with edge 16, a hinge 17 allowing the lid 4 to rotate between a position in which it is open and a position in which it is closed.

The packet 1 also comprises an inner frame 18, fixed to the container 2 and comprising a portion 18*a* positioned inside the container 2, and a portion 18*b* protruding from the open end 3 of the container 2. The inner frame 18 has a central surface 19, whose lower edge 20, on the side of surface 8, is substantially U-shaped and, on the lid 4 side, a top edge 21 which is substantially parallel with the edge 20, thus defining a lower central portion 22 and two side tabs 23 which extend towards the lid 4. Surface 19 is fixed to the inside of surface 5, from which the tabs 23 and part of portion 22 protrude, and is integral with two side surfaces 24 of the inner frame 18 fixed to the inside of the respective surfaces 7, from which the surfaces 24 partially extend towards the lid 4.

Figure 3:
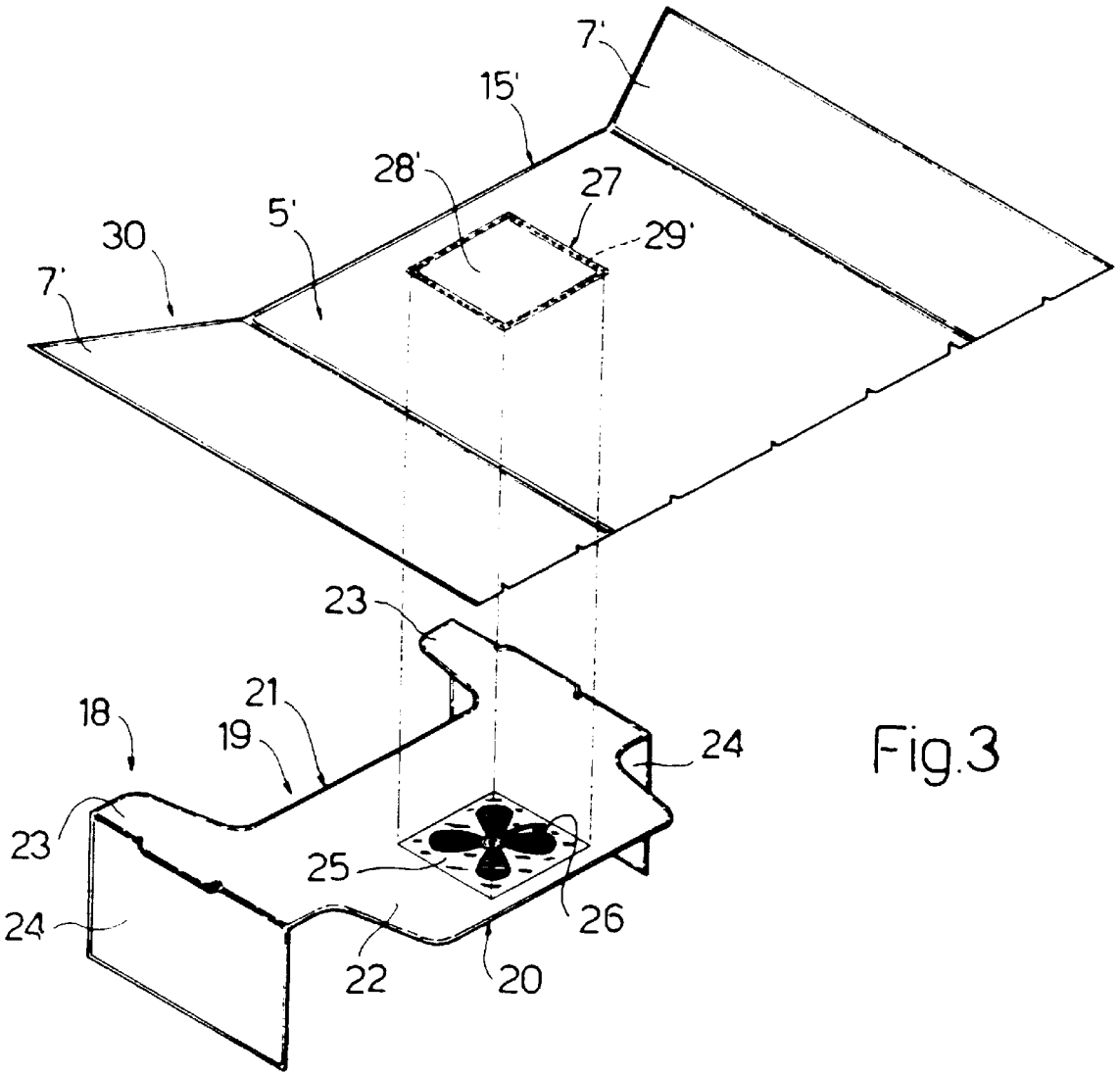
FIG. 3 is an enlarged exploded perspective view of a detail in FIG. 2.

As shown in FIG. 3, the part of portion 22 included in portion 18*a* has an intermediate zone 25, bearing graphics which in the embodiment illustrated consist of an image 26 facing the inside of surface 5, and at the zone 25, surface 5 has a window 27 through which the image 26 can be seen.

In a first embodiment, the zone 25 is covered by an removable element 28, consisting of a layer of opaque material which can be scratched off, whilst, in another embodiment, the window has a pre-weakened closed border 29, and the removable element 28 is delimited by the border 29 and consists of a tear-off element forming part of the surface 5.

As illustrated in FIG. 3, the container 2 and lid 4 are obtained (in the known way, not illustrated) from a blank 30, which is only partially illustrated, since it differs from a normal blank of the known type only in that it has a window 27 or pre-weakened border 29 around the window 27. The parts of the blank 30 illustrated are labeled with reference numbers followed by a prime character and are the same as the reference numbers used to label the corresponding parts of the packet and, therefore, require no further explanation.

However, it is necessary to point out that, firstly, the creation of the graphics for the packet 1 can be significantly simplified by positioning part of the graphics at the zone 25 of the inner frame 18 and, secondly, the packet can be made using a standard packaging machine (not illustrated) of the known type, with evident economic advantages and production flexibility.

What is claimed:

1. A rigid hinged-lid packet for long elements, the packet comprising a cup-shaped container, which in turn comprises a front surface, a rear surface and two side surfaces defining the open end of the container; an inner frame having a front portion and two side portions, these being attached to the front and side surfaces, the inner frame comprising a first portion positioned inside the container and a second portion protruding from the open end; and a cup-shaped lid, this being hinged at a rear edge of the open end so that the lid rotates between a position in which the container is open and a position in which it is closed; the packet being characterized in that the front surface has a window, this being designed to show a given zone of said first portion of the inner frame.

2. The packet as described in claim 1, wherein the zone bears graphics.

3. The packet as described in claims 1 or 2, wherein there are removable covering means, said means being designed to hide the given zone.

4. The packet as described in claim 3, wherein the removable covering means define a closing element for the window.

5. The packet as described in claim 4, wherein the closing element is a tear-off element.

6. The packet as described in claim 5, wherein the front surface has a pre-weakened closed border, said border surrounding the window and tear-off removable closure.

7. The packet as described in claim 3, wherein the removable covering means consist of a layer of opaque material which can be removed by scratching.

* * * * *